US006143156A

United States Patent [19]

Zhang

[11] Patent Number: 6,143,156

[45] Date of Patent: Nov. 7, 2000

[54] ELECTROPLATING METHOD AND APPARATUS

[75] Inventor: Ming Jason Zhang, Montreal, Canada

[73] Assignee: CAE Vanguard, Inc., Minneapolis, Minn.

[21] Appl. No.: 09/122,251

[22] Filed: Jul. 24, 1998

[51] Int. Cl.[7] ..... C25D 5/06

[52] U.S. Cl. ..... 205/93; 204/200; 204/203; 204/209; 204/215; 204/217; 204/224 R; 205/117; 205/137

[58] Field of Search ..... 205/93, 117, 137; 204/200, 203, 209, 215, 217, 224 R

[56] References Cited

U.S. PATENT DOCUMENTS

| | | | |
|---|---|---|---|
| 3,619,383 | 11/1971 | Eisner | 205/93 |
| 4,129,492 | 12/1978 | Morton et al. | 204/212 |
| 4,270,986 | 6/1981 | Smith | 205/206 |
| 4,610,772 | 9/1986 | Palnik | 204/206 |
| 4,655,881 | 4/1987 | Tezuka et al. | 205/104 |
| 4,772,361 | 9/1988 | Dorsett et al. | 205/93 |
| 5,116,480 | 5/1992 | Palnik | 204/206 |
| 5,277,785 | 1/1994 | Van Anglen | 205/117 |
| 5,324,406 | 6/1994 | Anderson et al. | 204/224 R |
| 5,389,228 | 2/1995 | Long et al. | 205/110 |
| 5,453,174 | 9/1995 | Van Anglen et al. | 205/117 |
| 5,571,389 | 11/1996 | Kerampran | 204/224 T |

OTHER PUBLICATIONS

*Nickel and Chromium Plating*, Third Edition, J.K. Dennis and T. E. Such, Woodhead Publishing Limited, Cambridge, England, 1993, month of publication not available.

SIFCO Process® Instruction Manual. © 1994 SIFCO Industries, Inc., pp. 47, 51, 52, and 53, month of publication not available.

*Primary Examiner*—Kathryn Gorgos
*Assistant Examiner*—William T. Leader
*Attorney, Agent, or Firm*—Dorsey & Whitney LLP

[57] ABSTRACT

The present invention provides an improved method for electroplating metallic ions onto a conductive substrate. In one embodiment, the method comprises at least partially covering a selected surface of the conductive substrate with an electrode wrap that includes a pad having an abrasive surface.

The metallic ions are electrically depositing onto the selected surface through the electrode wrap while the conductive substrate is moved (e.g., rotated) relative to the electrode wrap. A substantially constant frictional force is controllably applied from the abrasive surface onto the selected surface while the metallic ions are being deposited. In this manner, a substantially constant abrasive force is applied to the selected surface as the thickness of the deposited metallic coating increases to create a relatively smooth, uniform, thick deposition that is substantially free of defects.

14 Claims, 5 Drawing Sheets

(A ) CLOSE POSITION (B) OPEN POSITION (A) SEVERAL INDIVIDUAL PIECES OF ABRASIVE PAD (B) ONE PIECE OF CONTINUOUS ABRASIVE PAD

CLOSE POSITION

OPEN POSITION

SEVERAL INDIVIDUAL PIECES OF ABRASIVE PAD

ONE PIECE OF CONTINUOUS ABRASIVE PAD

ELECTROPLATING METHOD AND APPARATUS

1. TECHNICAL FIELD

The present invention relates generally to a method and apparatus for electroplating a metallic ion onto a conductive substrate. In particular, the present invention relates to an improved brush plating scheme that enables a relatively thick metal coating to be deposited onto the conductive substrate.

2. BACKGROUND OF THE INVENTION

In traditional brush plating processes, a positively charged anode is closely positioned to a negatively charged conductive substrate which functions as a cathode. An absorbent wrapping, incorporated within the anode, is wrapped about the surface of the substrate. In turn, an electroplating solution having metallic ions is supplied to the wrapping and thereby made available to the substrate. A direct electric potential is applied between the anode and the substrate to cause the positively charged metallic ions to be deposited from the electroplating solution onto the surface of the substrate.

Unfortunately, with present systems, it has been difficult, if not impossible, to achieve thick, dense metallic depositions that are free of structural flaws. Thick metal depositions may be obtained in several layering steps, but these depositions are either rough or can include defects or have inferior bonding strength between layers as the deposition becomes thicker.

Accordingly, what is needed in the art is an improved method and apparatus for electroplating a relatively thick, substantially defect-free metallic deposition onto a conductive substrate.

3. SUMMARY

The present invention provides an improved method for electroplating metallic ions onto a conductive substrate. In one embodiment, the method comprises at least partially covering a selected surface of the conductive substrate with an electrode wrap that includes a pad having an abrasive surface. The metallic ions are electrically deposited onto the selected surface through the electrode wrap while the conductive substrate is moved (e.g., rotated) relative to the electrode wrap. A substantially constant force is controllably applied from the abrasive surface onto the deposited metallic coating that forms on the selected surface. In this manner, a substantially constant abrasive force is applied to the selected surface even as the thickness of the deposited metallic coating increases which creates a relatively smooth, uniform, thick deposition that is substantially free of defects.

An apparatus is also provided for depositing metallic ions onto the selected surface of a substrate. One embodiment of the apparatus comprises an electrode wrap, an electroplating solution source, and an actuator assembly. The electrode wrap is adapted to at least partially cover the selected surface when the apparatus is to be operated. The electrode wrap includes a frame, an electrode mounted to the frame, and a pad mounted adjacent to the electrode. The pad has an abrasive surface adapted to be in contact with the selected surface when the apparatus is in operation, with the conductive substrate being in motion relative to the electrode wrap. The frame is adjustably proximate to the selected surface so that a controllable frictional force may be applied to the selected surface when the apparatus is in operation. The electroplating solution source is operably connected to the pad to supply it with an electroplating solution having metallic ions. The metallic ions are electrically deposited onto the selected surface of the substrate when the apparatus is in operation. The actuator assembly is operably linked to the frame to adjust its proximity to the selected surface to control the frictional force exerted by the abrasive surface onto the selected surface when the apparatus is in operation.

4. BRIEF DESCRIPTION OF THE DRAWINGS

5. DETAILED DESCRIPTION

Figure 1:
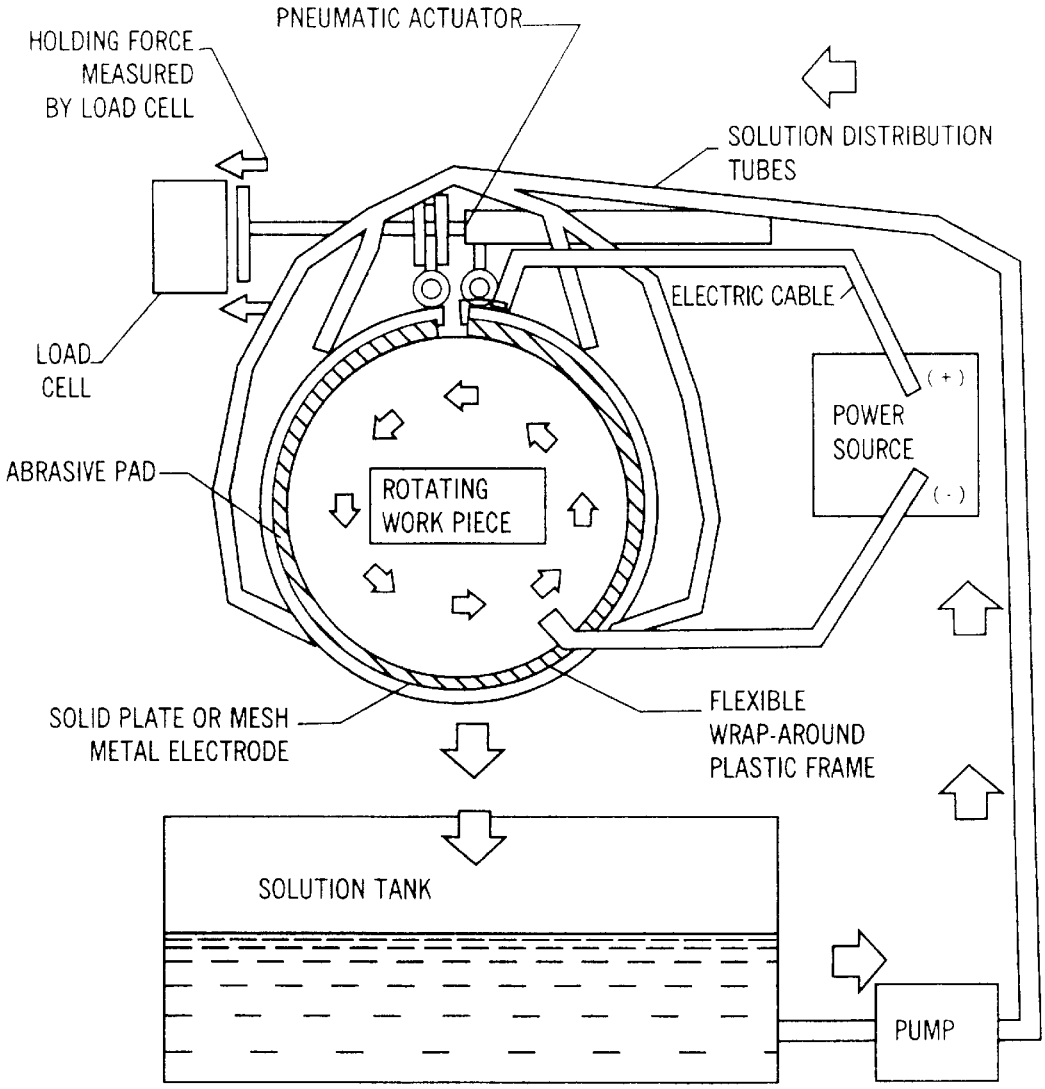
FIG. 1A is a partial, schematic end view of one embodiment of an apparatus of the present invention.
FIG. 1B is a top view of the apparatus depicted in FIG. 1A taken along line 1B—1B.
Figure 1A:
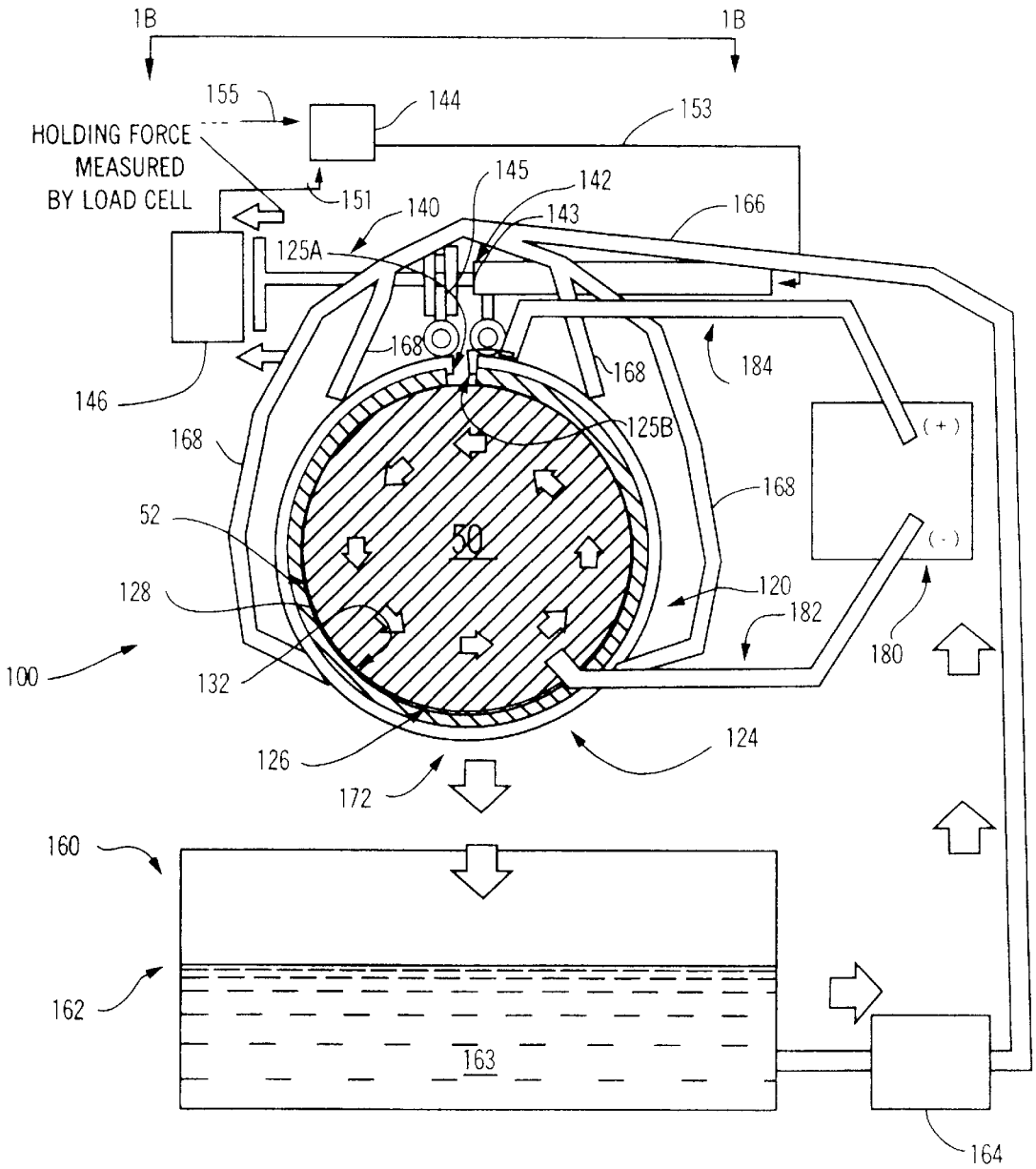
Figure 1B:
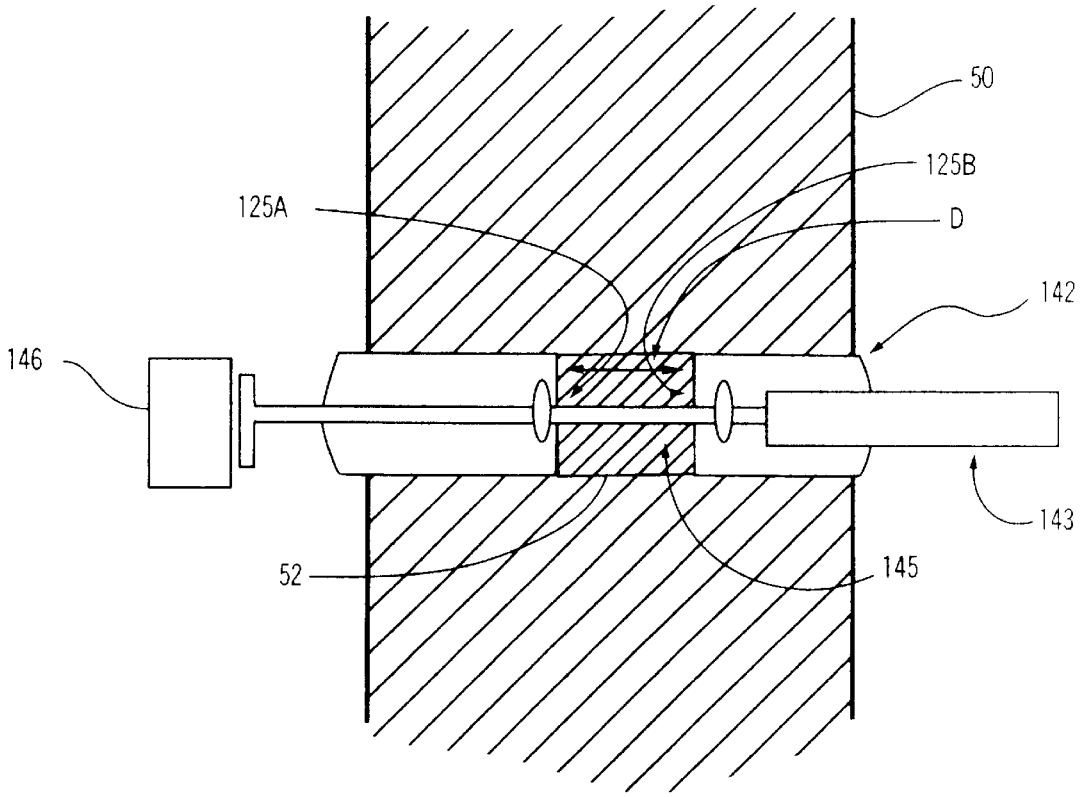
Figure 3:
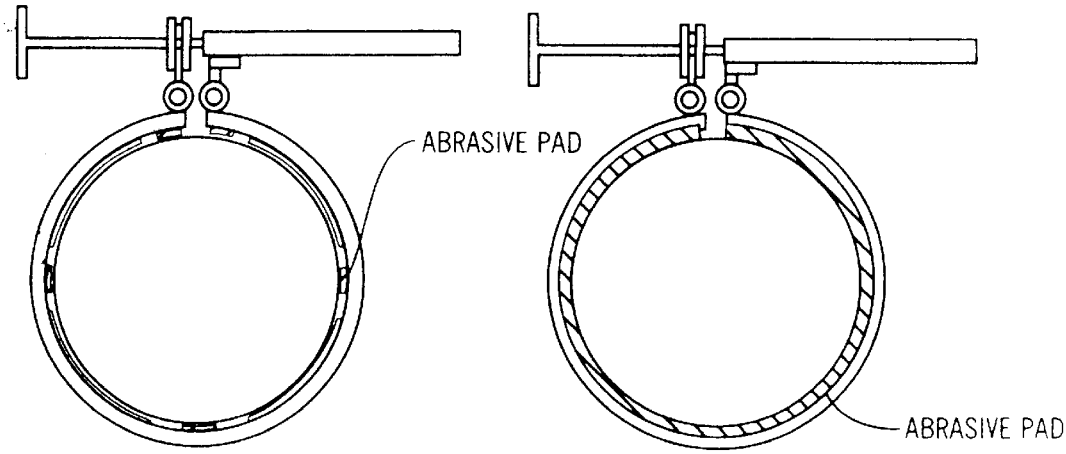
FIG. 3A depicts an end view of an apparatus of the present invention showing an electrode wrap with a plurality of individual pads.
FIG. 3B depicts an end view of an apparatus of the present invention showing an electrode wrap with a unitary, continuous pad.

FIGS. 1A and 1B show a first embodiment of an apparatus 100 for electroplating the selected surface 52 of a conductive substrate 50. In the depicted embodiment, the apparatus 100 comprises an electrode wrap 120, an actuator assembly 140, an electroplating solution source 160, and a power source 180. The actuator assembly 140 is operably linked to the electrode wrap 120 for adjusting the electrode wrap's proximity to the selected surface 52 of the conductive substrate 50. The electroplating solution source 160 is operably connected to the electrode wrap 120 to provide it with a continuous flow of electroplating solution from which metallic ions to be deposited onto the selected surface 52 are derived. The power source 180 is operably connected to the substrate 50 and the electrode wrap 120 to provide an electrical potential between these components (i.e., electrodes) that is sufficient to promote deposition of metallic ions from the electroplating solution through the electrode wrap 120 onto the selected surface 52 of the conductive substrate 50. The apparatus 100 also includes a conventional mechanism (not shown) for moving (e.g., rotating as with a lathe) the selected surface 52 relative to the electrode wrap 120. In the depicted embodiment, the conductive substrate 50 is rotated about its cylindrical axis as shown in FIG. 1A.

In the depicted embodiment, the conductive substrate 50 is a solid, metallic shaft that functions as the cathode with the electrode wrap serving as the anode. However, a conductive substrate may be composed of any suitable material including but not limited to metals (e.g., carbon steel, stainless steel, aluminum, copper, alloys), conductive plastics, and conductive polymers. Moreover, in the depicted embodiment, the conductive substrate is a shaft with the selected surface 52 being a cylindrical portion of the conductive substrate's surface. It should be recognized, however, that the conductive substrate may be of any suitable shape so long as the electrode wrap 120 is adapted to be adjustably adjacent to a selected surface that can move relative to the electrode wrap 120. For example, the selected surface could be conical, planer, or contoured. In addition, while in the depicted embodiment the conductive substrate is moved, the apparatus could be designed so that the electrode wrap itself rather than the conductive substrate is moved, e.g., akin to the belt of a sander.

5.1 Electrode Wrap

FIGS. 1A and 1B show one embodiment of an electrode wrap 120. In the depicted embodiment, electrode wrap 120 includes a frame 124 having first and second ends 125A, 125B, a source electrode 126, and a pad 128 that has an abrasive surface 132. The source electrode 126 is mounted to the frame, and the pad 128 is mounted adjacent to the source electrode 126 such that the abrasive surface 132 is adjacent to the selected surface 52 of the conductive substrate 50 when the apparatus 100 is in operation. In one embodiment, frame 124 is made from a flexible material, which enables it to conform about at least part of the selected surface 52 of the conductive substrate 50. The flexible frame 124 may be formed from any suitable nonconductive material. Such a material could include but is not limited to a rubber, a plastic, or a polymer such as polyethylene, flexible nylon, polyurethane, and PTFE Teflon. In one embodiment, this material is within a hardness range of between Shore D45 and Shore D70.

The source electrode 126 may be any suitable conductive member that can be charged in relation to the conductive substrate 50 to cause metallic ions from the electroplating solution to be deposited from the electrode wrap 120 onto the selected surface 52. As shown in FIGS. 1A and 1B, the source electrode 126 may function as an anode with the conductive substrate serving as the cathode. The source electrode 126 may be made from any suitable material such as a flexible metal mesh or a flexible continuous metal sheet. Suitable electrode metals include but are not limited to pure platinum, platinum clad niobium, platinum clad titanium, and stainless steel.

Figure 3A:
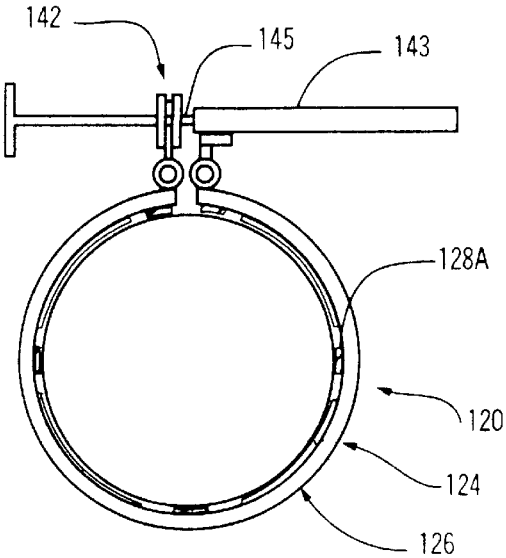
Figure 3B:
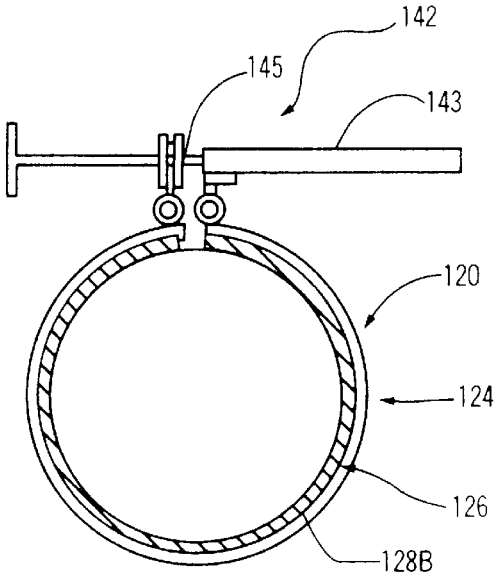

The pad 128 is mounted to the source electrode 126 to uniformly separate it from the selected surface 52 when the apparatus 100 is in operation. In addition, pad 128 has an abrasive surface 132 that engages the selected surface 52 to apply upon it an abrasive, frictional force while apparatus 100 is in operation with the conductive substrate 50 rotating about its cylindrical axis. As shown in FIG. 3A, the pad 128A may be composed of several individual pieces of pad, or alternatively, as shown in FIG. 3B, the pad 128B may be composed of a single, continuous pad. The pad 128 may be formed from any suitable material that can (1) convey electroplating solution 163 to the selected surface 52 from the electroplating solution source 160 and (2) retain a suitable abrasive surface 132 for applying a suitable abrasive force upon the metallic ion deposition while apparatus 100 is in operation. A suitable pad 128 with abrasive surface 132 could be implemented with any of the following commercially available abrasive pads: Scotchbrite™, Bear-Tex™, Anderlex™, Briterite™, Abrasolex™, and Fiberatex™. The abrasive surface 132 should be both coarse enough to sufficiently grind the deposited metallic coating and yet fine enough (in relation to the force exerted from the frame 124 onto the selected surface 52/metallic coating) to inhibit defects from being induced onto the deposited metallic coating. Such a suitable abrasive surface could be formed, for example, from a nonwoven fine or very fine grade abrasive.

5.2 Actuator Assembly

Figure 2:
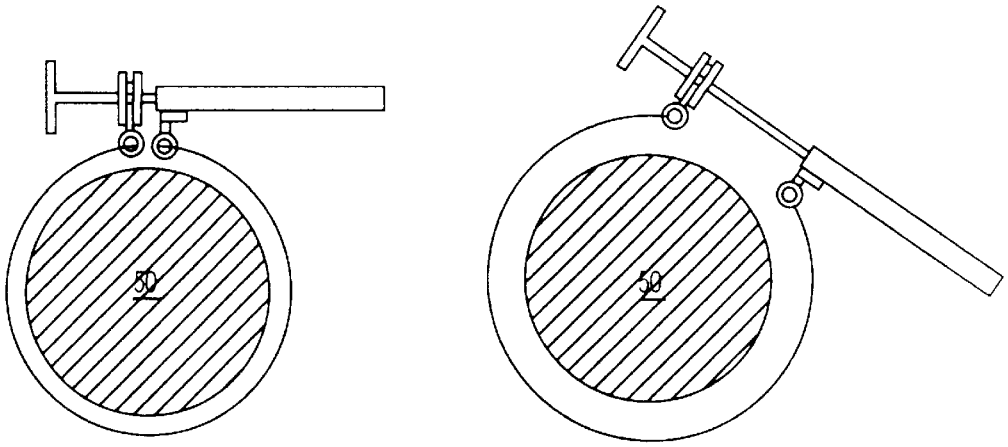
FIG. 2A is an end view of the apparatus of FIGS. 1A and 1B showing one embodiment of a frame in a closed position.
FIG. 2B is a view of the apparatus of FIG. 2A showing the frame in an open position.
Figure 2A:
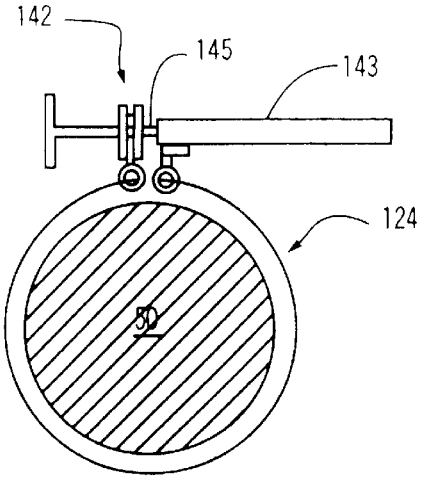
Figure 2B:
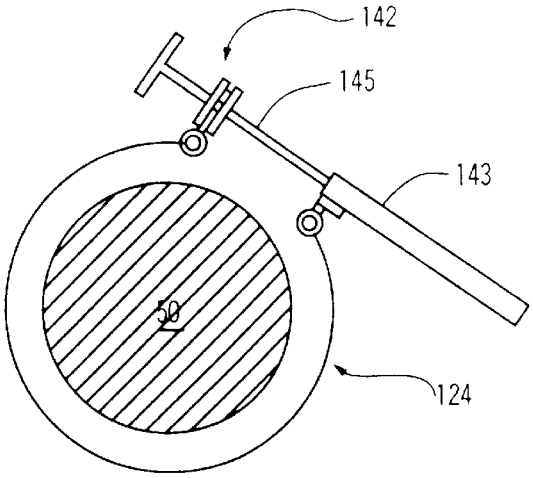

In the depicted embodiment of FIGS. 1A and 1B, the actuator assembly 140 includes an actuator 142, a controller 144, and a frictional feedback sensor 146. As best shown in FIGS. 2A and 2B, the actuator 142 is operably connected to the first and second ends 125A, 125B, respectively, of the frame 124 to control the proximity of the electrode wrap 120 to the selected surface 52 in order to control the abrasive frictional force applied from the abrasive surface 132 onto the selected surface 52. In the depicted embodiment, actuator 142 is a clamping device that includes a pneumatic cylinder 143 and a piston 145 for controllably adjusting the distance D (FIG. 1B) between the first and second ends 125A, 125B of the frame 124 from a closed position (FIG. 2A) to an open position (FIG. 2B). In this manner, the actuator 142 can control the frictional force applied to the selected surface.

The frictional feedback sensor 146 is operably connected to the actuator 142 to provide a frictional feedback signal that measures the frictional force exerted by the abrasive surface 132. The controller 144 is electrically connected to the actuator 142 through actuator control line 153 to control the actuator 142 in order to control the distance D between the first and second sides 125A, 125B. In addition, the controller 144 is electrically connected to the frictional feedback sensor 146 through feedback line 151 to receive the frictional feedback signal. The controller 144 also includes controller input line 155 to receive any necessary command inputs for controlling the actuator 142. In one embodiment, the frictional feedback sensor may be a load cell of the type commonly used in the art.

The actuator 142 may be any suitable device for controlling the frictional force applied from the abrasive surface 132 onto the selected surface 52. For example, if the actuator 142 is a clamping system as shown in the figures, it could be implemented with a screw and nut assembly, a hydraulic cylinder, or a pneumatic cylinder.

The frictional feedback sensor 146 may be any suitable transducer for providing to the controller 144 a frictional feedback signal that corresponds to the abrasive force applied to the selected surface 52. For example, frictional feedback sensor 146 could be implemented with an analog or digital force gauge.

The controller 144 may be any suitable controller (e.g., analog, digital, human) including any necessary peripheral components (e.g., memory, input/output circuitry) for controlling the frictional force applied onto the selected surface in response to the frictional feedback signal from the frictional feedback sensor 146 and any command signal inputs received from controller input line 155.

5.3 Electroplating Solution Source

As best depicted in FIG. 1A, one embodiment of the electroplating solution source 160 includes tank 162 having electroplating solution 163, pump 164, source tubing 166, distribution tubing 168, and electroplating solution return 172. Pump 164 is fluidly connected between the tank 162 and source tubing 166 to draw electroplating solution 163 from the tank 162 to the source tubing 166. Distribution tubing 168 is connected between source tubing 166 and the electrode wrap 120 to evenly distribute the electroplating solution 163 throughout pad 128. In the depicted embodiment, the electroplating solution return 172 is an opening at the underside of frame 124 between the electrode wrap 120 and tank 162 to gravitationally return electroplating solution from the electrode wrap 120 to the tank 162.

Persons of ordinary skill in the art will recognize that the various components of the electroplating solution source may be implemented with suitable, conventional devices. The electroplating solution 163 may be any conventional electroplating solution for pure metals, alloys, or metal composites. Such metals and metal composites could include but are not limited to nickel, chromium, iron, cobalt, copper, NiW, CoW, Ni—SiC, and Ni—WC.

5.4 Power Source

Power Source 180 may be any conventional direct current ("DC") electrical source suitable for electroplating applications. Power Source 180 includes cathode line 182 and anode line 184 for providing a sufficient DC electrical potential between the conductive substrate 50 and source electrode 126. In the depicted embodiment, with positively charged metallic ions (i.e., cations), the cathode line 182 is electrically connected to the conductive substrate and the anode line 184 is electrically connected to the source electrode 126. The power source 180 should be capable of supplying DC voltages of at least 10 VDC to cause the metallic ions to deposit onto the selected surface 52 of the conductive substrate 50.

5.5 Operation

The operation of the depicted apparatus 100 will now be described. Pump 164 draws electroplating solution 163 through source tubing 166 and distribution tubing 168 to evenly distribute the electroplating solution 163 throughout pad 128. With electroplating solution comprising positively charged metallic ions (e.g., nickel) and power source 180 providing a sufficient DC potential (e.g., 15 VDC) between the source electrode 126 (anode) and conductive substrate 50 (cathode), the metallic ions deposit from the solution-saturated pad 128 onto the selected surface 52. While metallic deposition is occurring, the conductive substrate 50 is moved (e.g., rotated) relative to the electrode wrap 120. A command signal is input through controller input line 155 to cause the actuator 142 to maintain a preselected frictional force from abrasive surface 132 onto the selected surface 52. Thus, as the thickness of the metallic deposition increases, the controller 144, responsive to an increased frictional force sensed from frictional feedback sensor 146, controls the actuator 142 to increase the distance D between the first and second sides 125A and 125B of the frame 124 to gradually open the frame to maintain a consistent frictional force applied to the selected surface 52.

The preselected frictional force should be proportional to the size of the selected surface 52 (e.g., a value between 4.5 to 400 mN per square centimeter of selected surface 52). It should be sufficient in view of the abrasive surface 132 to properly grind the deposited metallic coating. Proper grinding of the deposited metallic coating means that the coating is sufficiently ground so that with fast deposition, dendritic deposits are not formed. That is, the thickness of the metallic deposition should remain substantially uniform and smooth over the entire selected surface 52. On the other hand, the applied frictional force must be deficient enough to (1) allow the overall thickness of the metallic deposition to grow, and (2) not impose defects into the metallic coating.

It will be seen by those skilled in the art that various changes may be made without departing from the spirit and scope of the invention. For example, controller 144 could be a human operator who sets the distance D between 125A and 125B according to the preselected frictional force shown by frictional feedback sensor 146. Subsequently, the human operator would periodically adjust the distance D in response to the reading of sensor 146 so as to substantially maintain the selected frictional force.

Accordingly, the invention is not limited to what is shown in the drawings and described in the specification but only as indicated in the appended claims.

6. REMARKS

Electroplating metals onto conductive substrates consistent with the teachings of the present invention enables relatively thick, defect-free depositions to be achieved. For example, sound nickel depositions in excess of 0.02" have been successfully electroplated with the present invention onto railway steel axles. Moreover, such a deposition can be achieved in a single, coating step that reduces the electroplating time and increases the structural integrity of the deposition.

Other advantages of the present invention will become more fully apparent and understood with reference to the appended drawings and claims.

What is claimed is:

1. An apparatus for depositing metallic ions onto the selected surface of a substrate, the apparatus comprising:

(a) an electrode wrap to at least partially cover the selected surface, the electrode wrap including a frame, an electrode mounted to the frame, and a pad mounted adjacent to the electrode, the pad having an abrasive surface adapted to be in contact with the selected surface when the apparatus is in operation with the conductive substrate being in motion relative to the electrode wrap, wherein the frame is adjustably proximate to the selected surface so that a controllable frictional force may be applied to the selected surface when the apparatus is in operation;

(b) an electroplating solution source operably connected to the pad for supplying an electroplating solution having metallic ions to the pad, wherein the metallic ions are electrically deposited onto the selected surface of the substrate when the apparatus is in operation; and (c) an actuator assembly operably linked to the frame to adjust its proximity to the selected surface to control the frictional force exerted by the abrasive surface onto the selected surface when the apparatus is in operation, wherein the actuator assembly includes an automated controller and a frictional feedback sensor that provides a frictional feedback signal the controller being operably connected to the frictional feedback sensor and to the actuator for controlling the frictional force applied to the selected surface in response to the frictional feedback signal.

2. The apparatus of claim 1, wherein the controller controls the actuator to substantially maintain the frictional force at a preselected value when the apparatus is in operation.

3. The apparatus of claim 1, wherein the substrate is rotatable about a first axis and the electrode wrap is coaxially aligned with the first axis when the apparatus is in operation.

4. The apparatus of claim 1, wherein the actuator is a pneumatic cylinder that is operably mounted to the frame of the electrode wrap.

5. The apparatus of claim 1, wherein the frictional feedback sensor is a load cell.

6. The apparatus of claim 1, wherein the electrode is an anode that is connected to the positive terminal of a DC power source, and the substrate is a cathode that is connected to the negative terminal of the DC power source.

7. The apparatus of claim 1, wherein the metallic ions are nickel.

8. The apparatus of claim 1, wherein the pad is an abrasive pad.

9. The apparatus of claim 1, wherein the frame is a flexible frame.

10. A method for electroplating a metallic coating onto a selected surface of a conductive substrate, comprising:

(a) at least partially covering a selected surface of the conductive substrate with an electrode wrap that includes a pad having an abrasive surface wherein the conductive substrate serves as a cathode and an electrode within the electrode wrap serves as an anode;

(b) moving the conductive substrate relative to the electrode wrap;

(c) electrically depositing a metallic coating onto the selected surface through the electrode wrap; and (d) controllably applying a substantially constant force from the abrasive surface onto the selected surface while the metallic coating is being deposited, wherein the act of controllably applying comprises measuring with a frictional feedback sensor a frictional force applied to the selected surface and controlling with an automated controller the frictional force in response to the measured frictional force, whereby a substantially constant abrasive force is applied to the metallic coating as its thickness increases.

11. The method of claim 10, wherein the act of moving the conductive substrate includes the act of rotating the conductive substrate about an axis, wherein the electrode wrap is coaxially aligned with the axis when the metallic coating is being deposited.

12. The method of claim 10, wherein the act of moving the conductive substrate relative to the electrode wrap includes the act of moving the electrode wrap while the conductive substrate is in a fixed position.

13. A conductive substrate having an electroplated metallic coating produced according to the method of claim 10.

14. The conductive substrate of claim 13, wherein the metallic coating comprises a single nickel layer that is substantially free of porosity.

* * * * *